United States Patent [19]

Largman et al.

[11] Patent Number: 4,908,052

[45] Date of Patent: Mar. 13, 1990

[54] FIBERS AND FILTERS CONTAINING SAID FIBERS

[75] Inventors: Theodore Largman, Morristown; Frank Mares, Whippany, both of N.J.; Clarke A. Rodman, East Providence, R.I.

[73] Assignee: Allied-Signal Inc., Morris Township, Morris County, N.J.

[21] Appl. No.: 300,194

[22] Filed: Jan. 23, 1989

Related U.S. Application Data

[63] Continuation of Ser. No. 40,446, Apr. 20, 1987, abandoned.

[51] Int. Cl.[4] ..... B01D 46/00

[52] U.S. Cl. ..... 55/486; 55/489; 55/528; 428/373; 525/177

[58] Field of Search ..... 428/373; 525/177; 55/486–489, 527, 528

[56] References Cited

U.S. PATENT DOCUMENTS

| | | | |
|---|---|---|---|
| 3,359,344 | 12/1967 | Fukushima et al. | 525/177 X |
| 3,534,120 | 10/1970 | Ando et al. | 525/177 X |
| 3,900,549 | 8/1975 | Yamana et al. | 525/177 X |
| 4,552,603 | 11/1985 | Harris et al. | 428/373 X |
| 4,609,710 | 9/1986 | Iohara et al. | 525/177 X |
| 4,784,892 | 11/1988 | Storey et al. | 55/528 X |

*Primary Examiner*—Charles Hart

*Attorney, Agent, or Firm*—Richard C. Stewart; Gerhard H. Fuchs

[57] ABSTRACT

This invention relates to a fiber comprising a major amount of a continuous phase comprising one or more melt processible polyesters of fiber forming molecular weight, and a minor amount of one or more polyolefins non-uniformly dispersed in said continuous phase such that the concentration of polyolefins at or near the surface of said fiber is greater than the concentration of polyesters at or near the surface of said fiber, and a process for preparing said fiber.

34 Claims, 1 Drawing Sheet

FIBERS AND FILTERS CONTAINING SAID FIBERS

This application is a continuation of application Ser. No. 040,446 filed Apr. 20, 1987, now abandoned.

BACKGROUND OF THE INVENTION

1. Field of the Invention

This invention relates to improved filter fibers and filters comprising said fibers. More particularly, this invention relates to such filter fibers comprising a polyester and a polyolefin, and filters comprising said fibers.

2. Prior Art

Polyesters are well known materials for the manufacture of fibers. Illustrative of such fibers are those described in U.S. Pat. Nos. 4,454,196; 4,410,473; and 4,359,557.

Polyolefinic materials are well known articles of commerce which have experienced wide acceptance in forming shaped objects and film or sheet material. The use of such materials has extended to the fiber and fabric industries. For example, U.S. Pat. Nos. 4,587,154; 4,567,092; 4,562,869; and 4,559,862.

Fibers containing mixtures of polyolefins and polyesters are known. For example, U.S. Pat. No. 3,639,505 describes fibers and films composed of a polymer alloy comprising an intimate blend of polyolefin, a minor amount of polyethylene terephthalate and 0.2 to 5 parts per hundred parts of polymer of a toluene sulfonamide compound which are described as having improved receptivity to dispersed dyes.

Bicomponent fibers are known in the art. For example, Textile World, Jun. 1986 at page 29 describes sheath/core fibers which have an inner core of polyester and have an outer core of polypropylene or polyethylene. Also see Textile World, Apr. 1986, page 31.

Bicomponent textile filaments of polyester and nylon are known in the art, and are described in U.S. Pat. No. 3,489,641. According to the aforesaid patent, a yarn that crimps but does not split on heating is obtained by using a particular polyester.

It is also known to employ as the polyester component of the bicomponent filament a polyester which is free from antimony, it having been determined that antimony in the polyester reacts with nylon to form a deposit in the spinneret which produces a shorter junction line, and thus a weaker junction line. Such products are claimed in U.S. patent application Ser. No. 168,152, filed Jul. 14, 1980.

It is also known to make bicomponent filaments using poly[ethylene terephthalate/5-(sodium sulfo) isophthalate] copolyester as the polyester component. U.S. Pat. No. 4,118,534 teaches such bicomponents.

It is also known to make bicomponent filaments in which the one component partially encapsulates the other component. U.S. Pat. No. 3,607,611 teaches such a bicomponent filament.

It is also known to produce bicomponent filaments in which the interfacial junction between the two polymeric components is at least in part jagged. U.S. Pat. No. 3,781,399 teaches such a bicomponent filament. Bicomponent filaments having a cross sectional dumbell shape are known in the art. U.S. Pat. No. 3,092,892 teaches such bicomponent filaments. Other nylon/-polyester bicomponent fibers having a dumbell cross sectional shape having a jagged interfacial surface, the polyester being an antimony-free copolyester having 5-(sodium sulfo) isophthalate units are known. U.S. Pat. No. 4,439,487 teaches such fibers. The surface of such bicomponent filament is at least 75% of one of the polymeric components. Still other nylon/polyester bicomponent sheath/core fibers are described in Japan Pat. Nos. 49020424, 48048721, 70036337 and 68022350; and U.S. Pat. Nos. 4,610,925, 4,457,974 and 4,610,928.

Fibers have previously been prepared from blends of polyamides with minor amounts of polyesters such as poly(ethylene terephthalate). Intimate mixing before and during the spinning process has been recognized as necessary to achieve good properties in such blended fibers. It is furthermore known that the fine dispersions in fibers of polymer blends are achieved when both phases have common characteristics such as melt viscosity. See D. R. Paul, "Fibers From Polymer Blends" in *Polymer Blends*, vol. 2, pp. 167–217 at 184 (D. R. Paul & S. Newman, ehs., Academic Press 1978).

Graft and block copolymers of nylon 6/nylon 66, nylon 6/poly(ethylene terephthalates) and nylon 6/poly(butylene terephthalate) have been formed into grafts which can be spun into fibers. For example, U.S. Pat. No. 4,417,031, and S. Aharoni, Polymer Bulletin, vol. 10, pp. 210–214 (1983) disclose a process for preparing block and/or graft copolymers by forming an intimate mixture of two or more polymers at least one of which includes one or more amino functions, as for example a nylon, and at least one of the remaining polymers includes one or more carboxylic acid functions, as for example a polyester, and a phosphite compound; and thereafter heating the intimate mixture to form the desired block and/or graft copolymers. U.S. Pat. No. 4,417,031 disclose that such copolymers can be spun into fibers.

The use of polyester fibers as the filter element for air filters of air breathing engines is known. For example, the use of such fibers is described in Lamb, George, E. R. et al., "Influence of Fiber Properties on the Performance of Nonwoven Air Fillers," *Proc. Air Pollut. Control Assoc.*, vol. 5, pp. 75–57 (Jun. 15–20; 1975) and Lamb, George E. R. et al. "Influence of Fiber Geometry on the Performance of Non Woven Air Filters," "*Textile Research Journal,*" *vol.* 45 No. 6 pp. 452–463 (1975).

SUMMARY OF THE INVENTION

The present invention is directed to a polyester based fiber useful for the filter element of air filters. More particularly, this invention comprises a polymer fiber comprising predominantly one or more melt spinnable polyesters having non uniformly dispersed therein one or more polyolefins; the concentration of said polyolefin at or near the outer surface of said fiber being greater than the concentration of said polyester at or near the surface of the fiber. As used herein, a "fiber" is an elongated body, the length dimension of which is greater than the transverse dimensions of width and thickness. Accordingly, the term fiber includes single filament, ribbon, strip and the like, having regular or irregular cross-section. The fiber of this invention exhibits improved capacity when used as the fibers of the filter element of an air filter.

Yet another aspect of this invention relates to a process of forming the fiber of this invention which comprises melt spinning a molten mixture comprising as a major component one or more melt spinnable polyesters and as a minor component one or more polyolefins forming a polymer fiber comprising predominantly said one or more polyesters having non uniformly dispersed therein said one or more polyolefins, the concentration of said polyolefins being greater at or near the outer surfaces of said fiber being greater than the concentration of said polyesters at or near the center of said fiber. Surprisingly, it has been discovered that during the melt spinning of the fibers, a portion of the polyolefins migrates to the surface of the fiber such that even though it is the minor component, the concentration of the polyolefins at or near the surface of the polyolefins at or near the surface of the fiber is greater than the concentration of polyesters at or near the surface.

DESCRIPTION OF THE INVENTION

Figure 1:
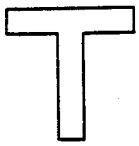
FIGS. 1 to 10 are cross-sections of various "Multilobal" fibers for use in this invention.

The fiber of this invention comprises two essential components. The fiber is predominantly a melt processible polyester of "fiber forming molecular weight." As used herein, "fiber forming molecular weight" is a molecular weight at which the polymer can be melt spun into a fiber. Such molecular weights are well known to those of skill in the art and may vary widely depending on a number of known factors, including the specific type of polymer. In the preferred embodiments of the invention, the molecular weight of the polyester is at least about 5,000, and in the particularly preferred embodiments the molecular weight of the polyester is from about 8,000 to about 100,000. Amongst these particularly preferred embodiments, most preferred are those embodiments in which the molecular weight of the polyester is from about 15,000 to about 50,000.

Polyester useful in the practice of this invention may vary widely. The type of polyester is not critical and the particular polyester chosen for use in any particular situation will depend essentially on the physical properties and features, i.e., desired in the final filter element. Thus, a multiplicity of linear thermoplastic polyesters having wide variations in physical properties are suitable for use in this invention.

The particular polyester chosen for use can be a homo-polyester or a co-polyester, or mixtures thereof as desired. Polyesters are normally prepared by the condensation of an organic dicarboxylic acid and an organic diol, and, therefore illustrative examples of useful polyesters will be described hereinbelow in terms of these diol and dicarboxylic acid precursors.

Polyesters which are suitable for use in this invention are those which are derived from the condensation of aromatic, cycloaliphatic, and aliphatic diols with aliphatic, aromatic and cycloaliphatic dicarboxylic acids. Illustrative of useful aromatic diols, are those having from about 6 to about 12 carbon atoms. Such aromatic diols include bis-(p-hydroxyphenyl) ether; bis-(p-hydroxyphenyl) thioether; (bis-(p-hydroxyphenyl)-sulphone; bis-(p-hydroxyphenyl)-methane; 1,2-(bis-(p-hydroxyphenyl)-ethane; 1-phenyl-(p-hydroxphenyl -methane; diphenyl-bis(p-hydroxyphenyl)-methane; 2,2-bis(4'-hydroxy-3'-dimethylphenyl)propane; 1,1- bis(p-hydroxyphenyl)-butane; 2,2-(bis (p-hydroxyphenyl)-butane; 1,1-(bis-(p-hydroxyphenyl-cyclopentane 2,2-(bis-(p-hydroxyphenyl)-propane (bisphenol A); 1,1-(bis-(p-hydroxyphenyl)-cyclohexane (bisphenol C); p-xylene glycol; 2,5 dichloro-p-xylylene glycol; p-xylenediol; and the like.

Suitable cycloaliphatic diols include those having from about 5 to about 8 carbon atoms. Exemplary of such useful cycloaliphatic diols are 1,4-dihydroxy cyclohexane; 1,4-dihydroxy methylcyclohexane; 1,3-dihydroxycyclopentane; 1,5-dihydroxycycloheptane; 1,5-dihydroxycyclooctane; 1,4-cyclohexane dimethanol; and the like. Polyesters which are derived from aliphatic diols are preferred for use in this invention. Useful and preferred aliphatic and cycloaliphatic diols includes those having from about 2 to about 12 carbon atoms, with those having from about 2 to about 6 carbon atoms being particularly preferred. Illustrative of such preferred diol precursors are propylene glycols; ethylene glycol, pentane diols, hexane diols, butane diols and geometrical isomers thereof. Propylene glycol, ethylene glycol, 1,4-cyclohexane dimethanol, and 1,4-butanediol are particularly preferred as diol precursors of polyesters for use in the conduct of this invention.

Suitable dicarboxylic acids for use as precursors in the preparation of useful polyesters are linear and branched chain saturated aliphatic dicarboxylic acids, aromatic dicarboxylic acids and cycloaliphatic dicarboxylic acids. Illustrative of aliphatic dicarboxylic acids which can be used in this invention are those having from about 2 to about 50 carbon atoms, as for example, oxalic acid, malonic acids, dimethyl-malonic acid, succinic acid, octadecylsuccinic acid, pimelic acid, adipic acid, trimethyladipic acid, sebacic acid, suberic acid, azelaic acid and dimeric acids (dimerisation products of unsaturated aliphatic carboxylic acids such as oleic acid) and alkylated malonic and succinic acids, such as octadecylsuccinic acid, and the like.

Illustrative of suitable cycloaliphatic dicarboxylic acids are those having from about 6 to about 15 carbon atoms. Such useful cycloaliphatic dicarboxylic acids include 1,3-cyclobutanedicarboxylic acid, 1,2-cyclopentanedicarboxylic acid, 1,3- and 1,4-cyclohexanedicarboxylic acid, 1,3- and 1,4-dicarboxymethylcyclohexane and 4,4'-dicyclohexydicarboxylic acid, and the like.

Polyester compounds prepared from the condensation of a diol and an aromatic dicarboxylic acid are preferred for use in this invention. Illustrative of such useful aromatic carboxylic acids are terephthalic acid, isophthalic acid and a o-phthalic acid, 1,3-, 1,4-, 2,6 or 2,7-naphthalenedicarboxylic acid, 4,4'-diphenyldicarboxylic acid, 4,4'-diphenylsulphone-dicarboxylic acid, 1,1,3-timethyl-5-carboxy-3-(p-carboxyphenyl)-indane, diphenyl ether 4,4'-dicarboxylic acid bis-p(carboxyphenyl)methane and the like. Of the aforementioned aromatic dicarboxylic acids, those based on a benzene ring such as terephthalic acid, isophthalic acid, and ortho-phthalic acid are preferred for use and amongst these preferred acid precursors, terephthalic acid is particularly preferred.

In the most preferred embodiments of this invention, poly(ethylene terephthalate), poly(butylene terephthalate), and poly(1,4-cyclohexane dimethylene terephthalate), are the polyesters of choice. Among these polyesters of choice, poly(ethylene terephthalate) is most preferred.

The amount of polyester included in the fiber of this invention may vary widely. In general, the amount of polyester will vary from about 99.5 to about 75 percent by weight based on the total weight of the fiber. In the preferred embodiments of the invention the amount of polyester in the fiber may vary from about 99 to about 85 percent by weight based on the total weight of the fiber, and in the particularly preferred embodiments of the invention the amount of polyester in the fiber may vary from about 90 to about 98 weight percent on the aforementioned basis. Amongst these particularly preferred embodiments, most preferred are those embodiments in which the amount of polyester in the fiber is from about 92 to about 95 weight percent based on the total weight of the fiber.

As a second essential component, the fiber of this invention includes one or more polyolefins. The molecular weight of the polyolefin may vary widely. For example, the polyolefin may be a wax having a relatively low molecular weight i.e., 500 to 1,000 or more. The polyolefin may also be melt spinnable and of fiber forming molecular weight. Such polyolefins for use in the practice of this invention are well known. Usually, the polyolefin is of fiber forming molecular weight having a molecular weight of at least about 5,000. In the preferred embodiments of the invention the molecular weight of the polyolefins is from about 8,000 to about 1,000,000 and in the particularly preferred embodiments is from about 25,000 to about 750,000. Amongst the particularly preferred embodiments most preferred are those in which the molecular weight of the polyolefins is from about 50,000 to about 500,000. Illustrative of polyolefins for use in the practice of this invention are those formed by the polymerization of olefins of the formula:

$$R_1R_2CH{=}CH_2$$

wherein: $R_1$ and $R_2$ are the same or different and are hydrogen or substituted or unsubstituted alkylphenyl, phenylalkyl, phenyl, or alkyl. Useful polyolefins include polystyrene, polyethylene, polypropylene, polyl(1-octadecene), polyisobutylene, poly(1-pentene), poly(2-methylstyrene), poly(4-methylstyrene), poly(1-hexene), poly(5-methyl-1-hexene), poly(4-methylpentene), poly(1-butene), poly(3-methyl-1-butene), poly(3-phenyl-1-propene), polybutylene, poly(methyl pentene-1), poly(1-hexene), poly(5-methyl-1-hexene), poly(1-octadecene), poly(vinyl cyclopentane), poly(vinylcyclohexane), poly(a-vinylnaphthalene), and the like.

Preferred for use in the practice of this invention are polyolefins of the above referenced formula in which R is hydrogen or alkyl having from 1 to about 12 carbon atoms such as polyethylene, polypropylene, polyisobutylene, poly(4-methyl-1-pentene), poly(1-butene), poly(1-pentene), poly(3-methyl-1-butene), poly(1-hexene), poly(5-methyl-1-hexene), poly(1-octene), and the like.

In the particularly preferred embodiments of this invention, the polyolefins of choice are those in which $R_1$ is hydrogen and $R_2$ is hydrogen or alkyl having from 1 to about 8 carbon atoms such as polyethylene, polypropylene, poly(isobutylene), poly(1-pentene), poly(3-methyl-1-butene), poly(1-hexene), poly(4-methyl-1-pentene), and poly(1-octene). Amongst these particularly preferred embodiments, most preferred are those embodiments in which $R_1$ is hydrogen and $R_2$ is hydrogen or alkyl having from 1 to about 6 carbon atoms such as polyethylene, polypropylene, poly(4-methyl-1-pentene), and polyisobutylene, with polypropylene being the polyolefin of choice.

The amount of polyolefins included in the fiber of the invention may vary widely and is usually from about 0.5 to about 25 percent by weight based on the total weight of the fiber. In the preferred embodiments of this invention, the amount of melt spinnable polyolefins is from about 1 to about 15 weight percent based on the total weight of the fiber; and in the particularly preferred embodiments of the invention the amount of melt spinnable polyolefins in the fiber is from about 2 to about 10 weight percent based on the total weight of the fiber. Amongst the particularly preferred embodiments, most preferred are those embodiments in which the amount of melt spinnable polyolefins is from about 3 to about 8.5 percent by weight based on the total weight of the fiber.

Surprisingly, it has been discovered that in the fiber of this invention the polyolefins are not uniformly dispersed throughout the polyester continuous phase. Rather, the concentration of the melt spinnable polyolefins at or near the surface of the fiber is higher than the concentration of the melt spinnable polyester at or near the surface of the fiber. The result is a fiber which when used in a fiber filter element has a higher capacity and efficiency as compared to polyester fibers which do not contain melt spinnable polyolefins. As used herein "at or near" the surface of the fiber is at least about 50 Å of the fiber surface. In the preferred embodiments of this invention, the weight percent of the polyolefin component in the portion of the fiber forming a sheath about all or a portion of the longitudinal axis of the fiber said sheath having a thickness of at least about 50 Å is at least about 50 weight percent based on the total weight of the sheath. In the particularly preferred embodiments of the invention, the amount of polyolefins contained in said sheath is at least about 80 percent by weight based on the total weight of the sheath, and in the most preferred embodiments the amount of polyolefins contained in the sheath is at least about 85 weight percent to about 98 weight percent being the amount of choice.

Various other optional ingredients, which are normally included in polyester fibers, may be added to the mixture at an appropriate time during the conduct of the process. Normally, these optional ingredients can be added either prior to or after melting of the polyester or polyolefin or a mixture of the polyester and polyolefin. Such optional components include fillers, plasticizers, colorants, mold release agents, antioxidants, ultra violet light stabilizers, lubricants, anti-static agents, fire retardants, and the like. These optional components are well known to those of skill in the art, accordingly, only the preferred optional components will be described herein in detail.

Figure 2:
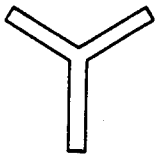
Figure 3:
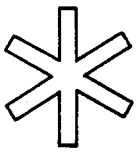
Figure 4:
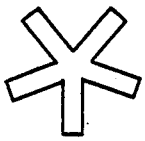
Figure 5:
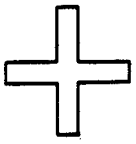
Figure 6:
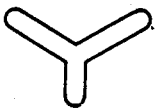
Figure 7:
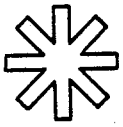
Figure 8:
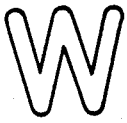
Figure 9:
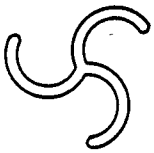
Figure 10:
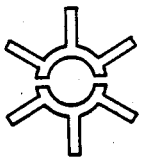

While certain cross-sections are preferred for certain uses, in general the cross-sectional shape of the fiber is not critical and can vary widely. The fiber may have an irregular cross section or a regular cross section. For example, the fiber can be flat sheets or ribbons, regular or irregular cylinders, or can have two or more regular or irregular lobes or vanes projecting from the center of axis of the fiber, such fibers are hereinafter referred to as "multilobal" fibers. Illustrative of such multilobal fibers are trilobal, hexalobal, pentalobal, tetralobal, and octalobal filament fibers. In the preferred embodiments of the invention the fibers are filament fibers having a multilobal cross section such that the surface area of the fiber is maximized, such as fibers having the representative cross-sections depicted in FIGS. 1 to 10. Illustrative of such preferred fibers are those fibers which are multilobal and having at least about three projecting lobes, or vanes or projections, and in the particularly preferred embodiments of the invention the fiber is multilobal having at least about five projecting lobes, vanes or projections such as hexalobal or octalobal fibers.

In the preferred embodiments of the invention in which fibers are multilobal, the "modification ratio" of the fiber can affect the effectiveness of the fiber as the filter element of a filter. As used herein, the "modification ratio" is the ratio of the average distance from the tip of the lobes or vanes of the fiber to the longitudinal center of axis of the fiber to the average distance from the base of the lobes or vanes of the fiber to the longitudinal center of axis of the fiber. In general, the greater the modification ratio of the fiber, the greater the effectiveness of the fiber as a filtering element; and conversely, the less the modification ratio of the fiber, the less its effectiveness as a filtering element. In the preferred embodiments of the invention, the modification ratio of the fiber is at least about 18, and in the particularly preferred embodiments of the invention is from about 2 to about 7. Amongst these preferred embodiments, most preferred are those embodiments in which the modification ratio of the fiber is from about 2.2 to about 5.

In the preferred embodiments of this invention, foamed fibers are implied in the fabrication of the filter elements. Such foamed fibers can be prepared by using conventional foaming techniques, as for example U.S. Pat. Nos. 4,562,022, 4,544,594, 4,380,594 and 4,164,603.

The fiber of this invention is prepared by the process of this invention which comprises:

(a) forming a molten mixture comprising as a major amount one or more polyesters of fiber forming molecular weight and as a minor amount of one or more polyolefins; and (b) melt spinning said mixture to form a fiber which comprises a major amount of a continuous phase comprising said polyesters and a minor amount of said polyolefins non-uniformly dispersed in said continuous phase such that the concentration of said polyolefins at or near the surface of said fiber is greater than the concentration of said polyesters at or near the center of said fiber.

A molten mixture is formed in the first process step. As used herein, "molten mixture" is an intimate mixture which has been heated to a temperature which is equal to or greater than the melting point of the highest melting polymer component of the mixture or an intimate mixture formed by melting one polymer and dispersing the other polymer in the melted polymer. The manner in which the molten mixture is formed is not critical and conventional methods can be employed. For example, in the preferred embodiments of the invention, the molten mixture can be formed through use of conventional polymer and additive blending means, in which the polymeric components are heated to a temperature equal to or greater than the melting point of the highest melting polymer, and below the degradation temperature of each of the polymers.

In the preferred embodiment, the components of the intimate mixture can be granulated, and the granulated components mixed dry in a suitable mixer, as for example a tumbler or a Branbury Mixer, or the like, as uniformly as possible. Thereafter, the composition is heated in an extruder until the polymer components are melted.

Fibers can be melt spun from the molten mixture by conventional spinning techniques. For example, the compositions can be melt spun in accordance with the procedures of U.S. Pat. Nos. 4,454,196 and 4,410,473. Foamed fibers can be melt spun using conventional procedures, as for example by the procedures of U.S. Pat. Nos. 4,562,022 and 4,164,603.

The fibers produced from the composition of this invention can be employed in the many applications in which synthetic fibers are used, and are particularly suited for use in the fabrication of filter elements of various types of air and liquid filters, such as air and liquid filters for industrial applications as for example filters for internal combustion engines, clarification filters for water and other liquids, compressed air filters, industrial air filters and the like employing conventional techniques. Fibers of this invention exhibit enhanced capacity and efficiency when are used as filter elements, as compared to polyesters which do not include minor amounts of the polyolefin.

The fibers of this invention are also useful in the fabrication of coverstock. For example, such fibers can be used as coverstock for absorbant materials in the manufacture of diapers, incontinence pads and the like.

The following examples are presented to more particularly illustrate the invention and should not be construed as limitations thereon.

EXAMPLES I to VI

Fibers Containing Polyethylene Terephthalate and Polypropylene and Containing Polyethylene Terephthate and Poly Methylpentene Polyethylene terephthalate (PET) received from St. Jude as chopped preforms was granulated into ⅛" (0.3175 cm) to ¼" (0.635 cm) pieces which were then dried in a Stokes vacuum tray drier at 0.5 mm Hg for 16 hrs. at 160° C. The dry PET was sealed in a jar along with a polyolefin and tumbled for fifteen minutes for uniform blending. The anhydrous mixture was placed in the hopper of a one inch (2.54 cm) diameter MPM extruder which was preheated to the desired temperature profile along the barrel of the extruder to yield a polymer melt temperature at the exit of the extruder of about 540° F. (282° C.). The screw was 1 inch (2.54 cm) in diameter and 30 inches (76.2 cm) long with a 4:1 compression ratio. It had a standard feed screw configuration with a modified mixing section consisting of a four inch (10.2 cm) long cross hatched zone located seven inches (17.8 cm) from the end of the screw. The extruder was equipped with a metering pump and a spinning block containing screens (eight layers, 90, 200, 200, 200, 200, 200, 200, 90 mesh top to bottom) and a spinnerette. The spinnerette had twenty (20) symmetrical hexalobal orifices, wherein each lobe has dimension of 4 mils (0.1 mm) (width)×25 mils (0.635 mm) (length)×20 mils (0.508 mm) (depth). The polymer mixture was extruded at a rate of 13 g/min. The filaments exiting from the spinnerette orifices were drawn down while being cooled in air to a temperature at which the filaments did not stick to the surface of a first take-up roll. Just above the first take-up roll, a finish was applied to the yarn to aid further processing and to dissipate any static charge buildup. The yarn on the first take-up roll was then drawn in line. The yarn on the first take-up roll which turned at 1670 rpm (2800 ft/sec) (853 m/sec) yarn speed was advanced to a second roll which turned at 4482 rpm (6500 ft/sec) (1981 m/sec) and from a second roll onto a third roll which turned also at 4482 rpm (6500 ft/sec) (1981 m/sec). The yarn was then advanced from the third roll to a Leesona winder at 6500 ft/sec (1981 m/sec), which wound the yarn upon a sleeve. The temperature of the rolls (heated by induction heating) were 120° C., 160° C. and 23° C. for rolls 1, 2 and 3 respectively. The results are set forth in the following Table I.

TABLE I

| Ex. No. | Amount of PET(g) | Amount of Polymer(g) | wt. % Polymer |
|---|---|---|---|
| I | 1900 g | 100 g PP[1] | 5% PP |
| II | 975 g | 25 g PP | 2.5% PP |
| III | 925 g | 75 g PP | 7.5% PP |
| IV | 950 g | 50 g PMP[2] | 5% PMP |
| V | 925 g | 75 g PMP | 7.5% PMP |
| VI | 962.5 g | 37.5 g PMP | 3.75% PMP |

[1]"PP" is spinning grade polypropylene obtained from Soltex Corporation under the trade name Soltex 3606.
[2]"PMP" is spinning grade polymethylpentene obtained from Mitsui Corporation under the trade name TPX.

COMPARATIVE EXAMPLE I

Fibers Containing polycaprolactam And Polypropylene

Using the procedure of Examples I to VI, 950 g of spinning grade polycaprolactam obtained from Allied Corporation under the trade name Capron ® LSB, and 50 grams of spinning grade polypropylene obtained from SOLTEX Corporation under the trade name Soltex ® 3606, were mixed and melt spun to obtain a 15 denier fiber containing five percent by weight of polypropylene.

COMPARATIVE EXAMPLE II

Analysis and Determination of the Nature of the Dispersion of the Components in the Fiber A series of experiments were conducted to illustrate the unique nature of fibers containing polyethylene terephthalate and a polyolefin as compared to fibers containing polycaprolactam and such polymers. The fibers of this invention selected for testing are those of Examples III and IV, and the nylon based fiber selected for testing is that of Comparative Example I. In these experiments, x-ray Photoelectron Spectroscopy (XPS) studies were carried out to determine the distribution of the minor amount of the polyolefin in the fiber. Procedure employed was as follows: The above fibers were wrapped around a strip of molybdenum foil in order to provide a support for mounting on the sample holder. After introduction into the analysis chamber of the spectrometer, liquid nitrogen was passed through the sample holder to cool the specimen to a temperature of ca. −70° C. as measured by a thermocouple. The analysis was performed on a PHI Model 560 electron spectrometer using MgK $\alpha$ radiation as the excitation source.

In addition, spectra of the pure PET, PP, nylon and PMP were taken for reference. Calculations of the surface composition were based on fitting of lineshapes of the pure components to the convoluted envelope of the mixture. As a secondary measure of the composition, peaks heights ratios were used for those cases involving PET utilizing the C=O and C—H peaks for determination of the relative quantity of PET. Agreement between the two methods of calculation was within 10%. Estimates of the sampling depth for the samples are on the order of 50–60 Å. In order to minimize decomposition under X-ray exposure, the samples were cooled to a temperature of ca. −70° C. during analysis.

The results indicated that the distribution of PP was substantially uniform in the fiber containing 5% PP (bulk concentration) of Comparative Example I and no segregation of PP at or near the surface regions of the fiber was not detected. For PET/7.5% PP fibers of Example III, the PP concentration within that portion of the fiber from 50 to 60 Å of the surface was determined to be 95–100% and the concentration of PET within this region was from 5 to 0%. This indicated that in contrast to the nylon/PP fiber of Comparative Example I, the concentration of PP in that region within 60 Å of the surface of the fiber is greater than the concentration of PET within that region, even though the concentration of PET within the fiber as a whole is very much greater than that of PP. Similarly, for PET/5% PMP fibers of Example IV, the concentration in the region within 60 Å of the surface of the fiber was determined to be 85–90%, while concentration of PET in this region was 15–10%. For the present experiments, it was not possible to determine if the PP or PMP distribution is homogeneous throughout the analysis volume or if a concentration gradient existed.

EXAMPLE VII

A series of experiments were carried out to compare the efficacy of the fibers of this invention as filter mediums to the efficacy of polyester alone for such use. Filter media used in these experiments were fabricated as follows:

The experimental fibers were crimped or texturized and cut into staple length of approximately 1½ inch (3.81 cm). The fibers were pre-opened on a roller top card and blended with 3DPF 1¼ inch (3.17 cm) staple crimped Vinyon Fibers (a copolymer binding fiber comprising 85% polyvinyl chloride 15% polyvinyl acetate). The blend comprising ⅔ by weight of the experimental fiber or control fiber and ⅓ by weight of the binder fiber. A 6 ounce/yd$^2$ (0.02 g/cm$^2$) air laid batting was made on a 12 inch wide laboratory air laying machine known as a Rando Webber. The air laid batting was needle locked on a needle punching machine. The needle locked batting was then needle punched to a spun bonded material known as DuPont's Reemay ® 2470, a 3 ounce/yd$^2$ (0.01 g/cm$^2$) fabric. Two control fibers were employed: (1) A 3, DPF trilobal cross section DuPont Dacron ® Polyester Fiber (crimped, 1½ inch (3.81 cm) staple length) and (2) and experimental 3 DPF 100% polyester 3 DPF hexalobal cross section fiber crimped or texturized and cut into a 1½ inch (3.81 cm) staple length. Both the unbacked needle locked air laid batting, and the reemay backed batting were heat stabilized for 5 minutes at 275° F. (135° C.) in a mechanical convection oven prior to flat sheet filtration performance testing.

After fabrications the filter mediums were evaluated. The properties selected for evaluation were capacity and efficiency because these properties are ultimately determinative of the effectiveness of a filter medium. The procedure employed is as follows:

On a flat sheet test apparatus, a 6½"×6½" (16.5 cm×16.5 cm) specimen was clamped. A 4×4 (10.16 cm×10.16 cm) mesh screen was used to support the unbacked test specimen; no screen was used to support the Reemay ® backed test specimen. A six inch (15.24 cm) diameter circle of the test specimen was subjected to an air flow of 25 CFM AC dust fine or coarse (1.0 g/in) was interspersed into the air stream by a feeder-aspirator mechanism. Air flow was straightened by a horn to produce uniform air flow velocity or laminar flow through the specimen. A tared absolute filter consisting of a micro glass phenolic bonded batting classified as AF 3½ inch (8.9 cm) by the fiber glass insulation industry, 10 inches (25.4 cm) in diameter below the test specimen was used for determining AC dust removal efficiency. The backed specimens were run until a 10 inch (25.4 cm) of water rise in pressure differential across the specimen is reached.

The test contaminant was a natural siliceous granular powder obtained from the Arizona desert classified to a specific particle size distribution and marketed by the AC Spark Plug Division of General Motors. The particle size distributions of the two test dusts are set forth in the following Table II.

TABLE II

| AC Fine | | AC Coarse | |
|---|---|---|---|
| Particle Size (μm) | % | Particle Size (μm) | % |
| 5.5 | <38 ± 3 | 5.5 | <13 ± 3 |
| 11 | <54 ± 3 | 11 | <24 ± 3 |
| 22 | <71 ± 3 | 22 | <37 ± 3 |
| 44 | <89 ± 3 | 44 | <56 ± 3 |
| 88 | — | 88 | <84 ± 3 |
| 176 | <100 | 176 | <100 |

Dust Removal efficiency of fine and coarse particles was determined by obtaining the weight increase of both the test specimen and the absolute filter:

$$\text{Dust removal efficiency } \% = \frac{W_1}{W_1 + W_2} \times 100$$

Where $W_1$ is the weight increase of the test specimen and $W_2$ is the weight increase of the absolute filter. Capacity is calculated as follows:

$$\text{Capacity in} = W_1 \; GMS$$

The results of this evaluation are set forth in the following Table III:

TABLE III

| Filter | AC Course Test Dust | | AC Fine Test Dust | |
|---|---|---|---|---|
| Medium | Capacity | Efficiency | Capacity | Efficiency |
| Polyester[1] | 12.9 | 99.3 | 8.29 | 99.0 |
| Polyester[2] | 9.8 | 99.0 | 8.14 | 98.9 |
| Example I | 15.34 | 99.3 | 8.17 | 99.0 |

[1]The Polyester fiber is hexalobal.
[2]The Polyester obtained from duPont Co. under

COMPARATIVE EXAMPLE III

A series of experiments were carried out to demonstrate that when a polyamide is substituted for a polyester in this invention, the polyolefin is more uniformly dispersed which results in inferior performance when used as a filter medium. The fiber of this invention used in the comparison study was the trilobal fiber prepared as described in Example I containing polyethylene terephthalate and 5% by weight PP, and the fiber of Comparative Example I containing polypoprolactam and 5% by weight PP.

The fibers were fabricated into a filter element and evaluated in accordance with the procedure of Example IV. The results are set forth in the following Table III.

TABLE III

| Filter | AC Course Test Dust | | AC Fine Test Dust | |
|---|---|---|---|---|
| Medium | Capacity | Efficiency | Capacity | Efficiency |
| Nylon/PP | 10.3 | 99.3 | 6.8 | 98.7 |
| Example I | 15.34 | 99.3 | 8.17 | 99.0 |

What is claimed is:

1. A filter element for removal of entrained solid particles from a fluid stream, each element comprising:

a body comprised of a network of fibers positioned to entrap all or a portion of said particles in said stream passing through said body, said fibers comprising a major amount of a continuous phase comprising one or more melt processible polyesters of fiber forming molecular weight and a minor amount of one or more melt processible polyolefins of fiber forming molecular weight dispersed in said continuous phase such that the concentration of said polyolefins at or near the surface of said fiber is greater than the concentration of said polyesters at or near the surface of said fibers.

2. A filter element according to claim 1 wherein said polyester is formed from the condensation of an aliphatic or cycloaliphatic diol, and an aromatic dicarboxylic acid.

3. A filter element according to claim 2 wherein said aromatic dicarboxylic acid is selected from the group consisting of terephthalic acid, isophthalic acid and orthophthalic acid.

4. A filter element according to claim 3 wherein said aromatic dicarboxylic acid is terephthalic acid.

5. A filter element according to claim 2 wherein said diol is an aliphatic diol.

6. A filter element according to claim 1 wherein said polyester is selected from the group consisting of poly(ethylene terephthalate), poly(butylene terephthalate) and poly(1,4-cyclohexane dimethylene terephthalate).

7. A filter element according to claim 6 wherein said polyester is poly(ethylene terephthalate).

8. A filter element according to claim 1 wherein said polyolefin is formed by polymerization of an olefin of the formula:

$$R_1R_2CH{=}CH_2$$

wherein $R_1$ and $R_2$ are the same or different and are alkylphenyl, phenylalkyl, phenyl, hydrogen or alkyl.

9. A filter element according to claim 8 wherein $R_1$ is hydrogen and $R_2$ is hydrogen or alkyl having from 1 to about 12 carbon atoms.

10. A filter element according to claim 9 wherein $R_2$ is hydrogen or alkyl having from 1 to about 8 carbon atoms.

11. A filter element according to claim 10 wherein $R_2$ is hydrogen or alkyl having from 1 to about 6 carbon atoms.

12. A filter element according to claim 11 wherein said polyolefin is selected from the group consisting of polyethylene, polypropylene, poly(4-methyl-1-pentene) and polyisobutylene.

13. A filter element according to claim 12 wherein said polyolefin is selected from the group consisting of polyethylene, polypropylene and poly(4-methyl-1-pentene).

14. A filter element according to claim 13 wherein said polyolefin is polypropylene or poly(4-methyl-1-pentene).

15. A filter element according to claim 14 wherein said polyolefin is polypropylene.

16. A filter element according to claim 1 wherein the amount of said polyolefins in said fiber is from about 0.5 to about 25 weight percent based on the total weight of the fiber.

17. A filter element according to claim 16 wherein the amount of said polyolefins in said fiber is from about 1 to about 15 weight percent.

18. A filter element according to claim 17 wherein the amount of polyolefins in said fiber is from about 2.5 to about 10 weight percent.

19. A filter element according to claim 18 wherein the amount of polyolefins in said fiber is from about 3 to about 8.5 weight percent.

20. A filter element according to claim 1 wherein the weight percent of polyolefin in the portion of the fiber forming a sheath about all or a portion of the longitudinal axis of the fiber of said sheath having a width of at least about 50 Å is at least about 50 weight percent based on the total weight of the sheath.

21. A filter element according to claim 20 wherein the amount of polyolefin contained in said sheath is at least about 80 percent by weight.

22. A filter element according to claim 21 wherein the amount of polyolefin contained in said sheath is at least about 85 percent by weight.

23. A filter element according to claim 1 wherein said polyolefin is of fiber forming molecular weight.

24. The filter element according to claim 22 wherein the amount of polyolefin in said sheath is from about 85 percent by weight to about 98 percent by weight.

25. A filter element according to claim 1 wherein said fiber is a filament or a plurality of filaments.

26. A filter element according to claim 25 wherein said fiber is a filament of substantially circular cross section.

27. A filter element according to claim 25 wherein said fiber is a filament of multilobal cross section.

28. A filter element according to claim 27 wherein said multilobal fiber has at least about 3 irregular or regular lobes or vanes projecting from the longitudinal axis of said fiber.

29. A filter element according to claim 28 wherein said fiber has at least about 4 projecting lobes or vanes.

30. A filter element according to claim 27 wherein the mod ratio of the fiber is at least about 1.8.

31. A filter element according to claim 30 wherein the mod ratio of the fiber is from about 2.0 to about 7.0.

32. A filter element according to claim 31 wherein the mod ratio of the fiber is from about 2.2 to about 5.

33. A filter element of claim 1 which is an air filter.

34. A filter element containing the fibers of claim 1.

* * * * *